United States Patent [19]

Wilkerson

[11] Patent Number: 4,958,740

[45] Date of Patent: Sep. 25, 1990

[54] BOTTLE FOR CONTAINING AND DISPENSING A PLURALITY OF DIFFERENT CONTENTS

[75] Inventor: Eugene R. Wilkerson, Destin, Fla.

[73] Assignee: Florida Isles Enterprises, Inc., Destin, Fla.

[21] Appl. No.: 399,842

[22] Filed: Aug. 29, 1989

[51] Int. Cl.[5] ..... B65D 1/04; B65D 23/10; B65D 41/04; B65D 41/16

[52] U.S. Cl. ..... 215/6; 220/20

[58] Field of Search ..... 215/6, 10; 206/315.1, 206/235, 581; 220/23.4, 20

[56] References Cited

U.S. PATENT DOCUMENTS

| | | | |
|---|---|---|---|
| 180,132 | 7/1876 | Hoard et al. | 215/6 |
| 197,542 | 11/1877 | Carman | 215/6 |
| 880,082 | 2/1908 | Kendrick | 215/6 |
| 1,487,576 | 3/1924 | Kendall | 215/6 |
| 2,035,404 | 3/1936 | Quinn | 215/1 R |
| 2,077,219 | 4/1937 | Conner | 215/6 |
| 2,215,161 | 9/1940 | Sapery | 215/6 X |
| 3,732,999 | 5/1973 | Rounkles | 215/6 |
| 3,767,203 | 10/1973 | Eaker | 206/315.1 X |
| 4,607,756 | 8/1986 | Courtman | 215/6 |
| 4,634,011 | 1/1987 | Polyblank | 215/6 |

FOREIGN PATENT DOCUMENTS

| | | | |
|---|---|---|---|
| 564499 | 9/1944 | United Kingdom | 206/235 |
| 904201 | 8/1962 | United Kingdom | 215/6 |

*Primary Examiner*—Sue A. Weaver

*Attorney, Agent, or Firm*—George A. Bode

[57] ABSTRACT

A bottle for containing and dispensing both liquid and solid substances comprising: a hollow main body portion of a generally oblong shape and of a uniform thickness and a handle portion integral with the upper portion of one of the sidewalls of the main body portion, the handle portion projecting laterally outward from one of the walls to form an integral container for the liquid substance. Both the main body portion and handle portion have concave and convex surfaces establishing hand grip portions. A smooth and continuous surface contiguous between the handle portion and upper portion of the one sidewall of the main body portion defines a web therebetween. The main body portion is provided with a threaded neck with a port therethrough for the introduction and removal of a liquid substance. A closure in the form of a threaded cap seals this port. An annular recess having a raised neck portion is provided in the surface of the body portion for storing a solid substance. A removable closure or cap is provided to snap onto the raised neck and seal the annular recess.

11 Claims, 3 Drawing Sheets

BOTTLE FOR CONTAINING AND DISPENSING A PLURALITY OF DIFFERENT CONTENTS

BACKGROUND OF THE INVENTION

1. Field of the Invention

The present invention relates to a bottle for storing and dispensing both a liquid and solid substance. More particularly, the present invention relates to a bottle to aid a sun worshiper in storing and dispensing both tanning lotion and oil and lip and nose protection gel.

2. General Background

The American society is very conscious of beauty standards, and with this consciousness has developed an industry which includes suntan lotions and oils and protective creams and gels. Heretofore, however, when both are desired, separate containers of each must be purchased. Thus, a need has developed to provide the public with a single container for both tanning lotion and oil and protective gel.

SUMMARY OF THE PRESENT INVENTION

The preferred embodiment of the apparatus of the present invention solves the aforementioned problem in a straight forward and simple manner. What is provided is a bottle for storing and dispensing both liquid and solid substances comprising: a hollow main body portion of a generally oblong shape and of a uniform thickness and a handle portion integral with the upper portion of one of the sidewalls of the main body portion, the handle portion projecting laterally outwardly from the sidewall to form an integral container for the liquid substance. The handle portion has concave and convex surfaces establishing a hand grip portion and a concave web portion including a smooth and continuous surface contiguous with the upper portion of the sidewall of the main body portion. The main body portion is provided with concave and convex surfaces so that it can be adapted as a hand grip also. The main body portion is provided with a threaded neck with a port therethrough for the introduction and removal of the liquid substance. A closure in the form of a threaded cap seals this port. An annular recess having a raised neck portion is provided in the surface of the main body portion for storing a solid substance such as protection gel. A removable closure or cap is provided to snap on to the raised neck and seal the annular recess.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
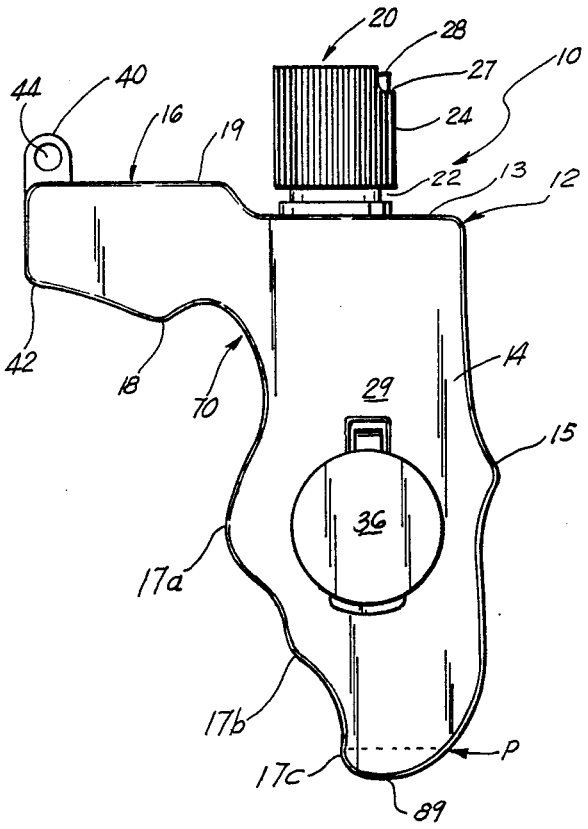
FIG. 1 is a front elevational view of the preferred embodiment of the present invention.
Figure 2:
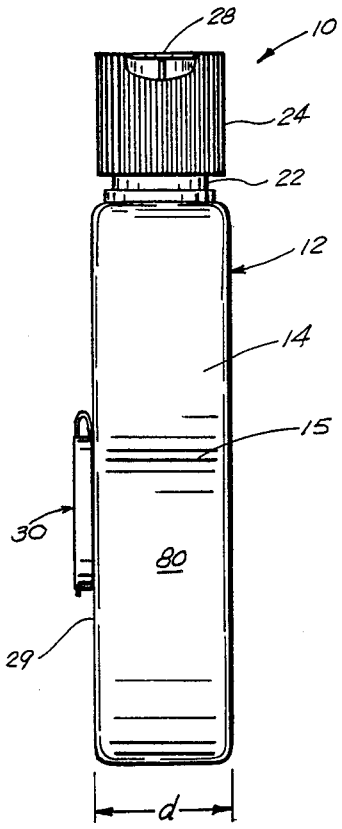
FIG. 2 is a side elevational view of the embodiment of FIG. 1.

Referring now to the drawings, and in particular FIGS. 1–7, the apparatus of the present invention is designated generally by the numeral 10. Apparatus 10 is a bottle for dispensing both liquid and solid substances. In the preferred embodiment, the bottle stores a liquid in the form of tanning lotion or oil and a solid in the form of cream or a protective gel. Apparatus 10 comprises a main body portion 14 of a generally oblong shape and the uniform thickness "d," best seen in FIGS. 2, 3 and 5 defining opposing sidewalls 80, 82 and upper surface 13 and lower surface 89. Sidewall 80 has a convex portion 15 and sidewall 82 has convex portions 17*a*, 17*b*, 17*c* defining concave portions therebetween thus establishing a hand grip means for main body portion 14. Lower surface 89 has a convex curvature, best seen in FIGS. 1 and 4, and extends in an arc from convex portion 17*c* of sidewall 82 to a point "p" on sidewall 80 opposite the apex of portion 17*c*.

Figure 3:
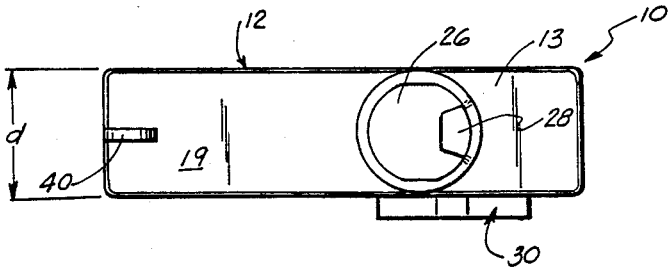
FIG. 3 is a top plan view of the embodiment of FIG. 1.
Figure 4:
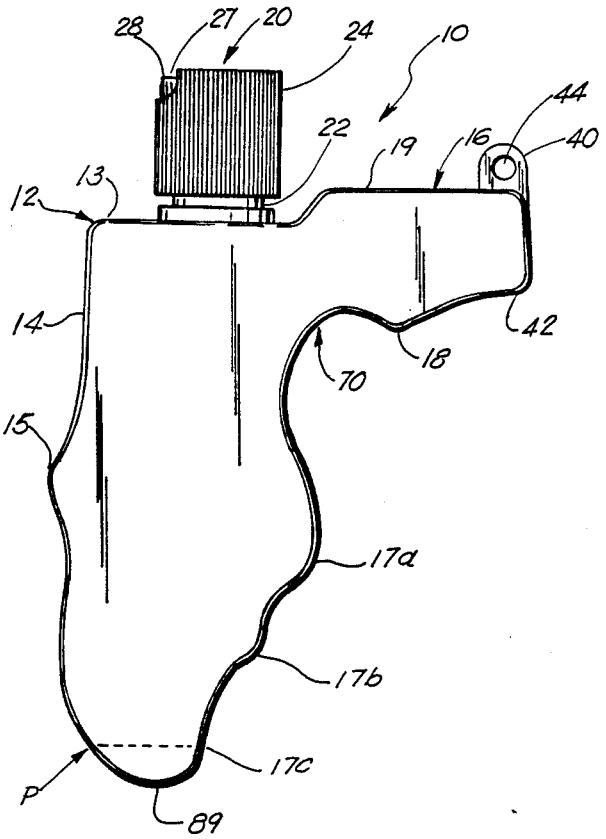
FIG. 4 is a rear elevational view of the embodiment of FIG. 1.
Figure 5:
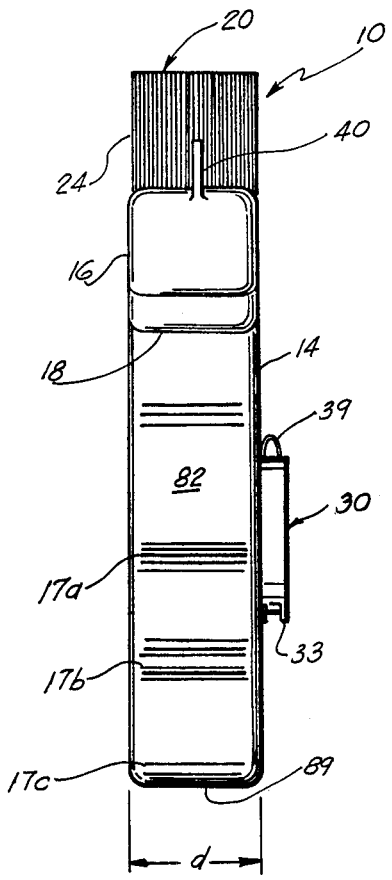
FIG. 5 is a side elevational view of the embodiment of FIG. 1.
Figure 6:
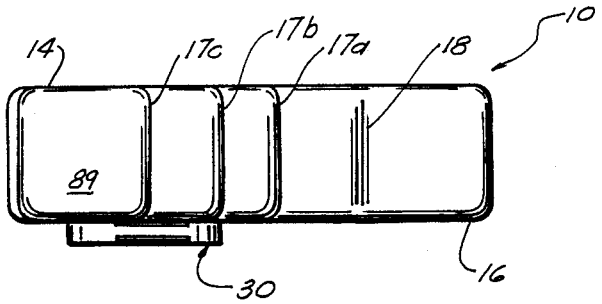
FIG. 6 is a bottom plan view of the embodiment of FIG. 1.
Figure 7:
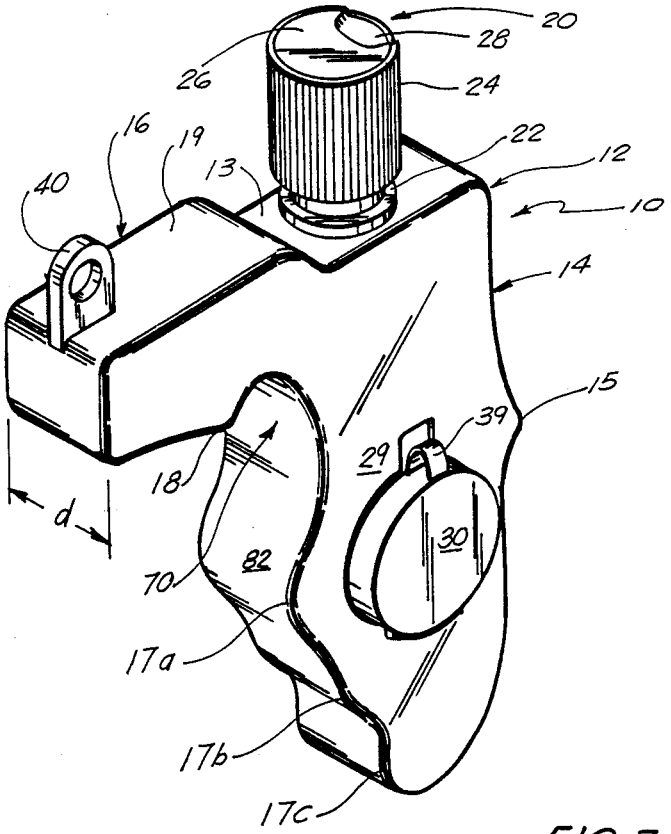
FIG. 7 is a top perspective view of the embodiment of FIG. 1.

A handle portion 16 is integrally formed with the upper portion of sidewall 82 of main body portion 14. Handle portion 16 projects or depends laterally substantially perpendicularly outwardly from sidewall 82. Handle portion 16 is of a generally rectangular shape and of the same uniform thickness "d," best seen in FIGS. 3, 5 and 7, as main body portion 14. Both main body portion 14 and handle portion 16 are hollow and communicate with each other. Thus, it can be seen that main body portion 14 and integral handle portion 16 form the body of the liquid container 12 of bottle 10. Handle portion 16 has a flat upper surface 19, as best seen in FIGS. 3 and 7, and a convex projection 18 depending from its lower surface which forms a convex surface and the concave web 70 which provides a smooth continuous surface contiguous with the upper portion of sidewall 82 of main body portion 14.

Provided in the upper surface 13 of main body portion 14 is neck 22 which provides a passageway or port (not shown) for inserting and removing any liquid substance from the container formed by main body portion 14 and integral handle portion 16. A closure means 20 in the form of a cap 24 with pivoting valve 26 is provided to seal the passageway. As best seen in FIGS. 1–4 and 7, the cap 24 is of a well-known type having a threaded inner diameter for threadably adapting to and sealing with the threaded outer diameter of the neck (not shown) and a notched portion 27 and pivoting valve 26 with an end portion 28 exposed by notch 27 and which pivots downwardly so that the opposite end can raise and expose a small aperture (not shown) for dispensing the liquid in small amounts. (To then close the small aperture the end portion opposite portion 28 is forced downwardly pivoting portion 28 upwardly).

A convenient feature provided on surface 19 at the distal end 42 of handle portion 16 is an eyelet 40 having an aperture 44 therethrough through which can be tied a string making for easy manual carrying of bottle 10.

Figure 8:
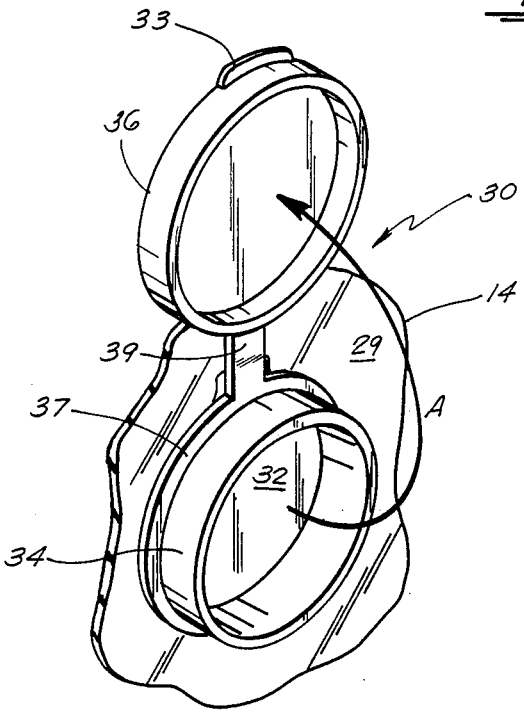
FIG. 8 is an enlarged view of the annular recessed container provided in the surface of the main body portion of the embodiment of FIG. 1.

As best seen in FIGS. 1–3 and 5–8, a container 30 for a solid substance—in the form of a cream or gel in the preferred embodiment—is provided in the form of an annular recess 32 provided in surface 29 of main body portion 14. As best seen in FIG. 8, annular recess 32 has coextensive therewith a raised neck portion 34. In this way, the chosen solid substance—cream or gel—can be stored. A closure means in the form of a cap 36 snaps onto neck portion 34 of container 30 to seal the same (cap 36 being of only a slightly larger diameter than neck 34). In the preferred embodiment, best shown in FIG. 8, cap 36 is fixedly attached to annular neck 34 by an integral ring 37 and connector 39, although this is optional. Cap 36 can be removed from sealing engagement with neck 34 by snapping it upwardly at lip 33 and rotating it in the direction of ARROW A.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A bottle for containing and dispensing liquid and solid substances comprising;

(a) a main body portion defining opposing sidewalls, said sidewalls having concave and convex surfaces thereby establishing a hand grip portion;

(b) a handle portion integrally formed with the upper portion of one of said sidewalls of said main body portion, said handle portion projecting laterally outwardly from said one of said sidewalls, said main body portion and handle portion communicating and thereby forming a first containing means of said bottle, said handle portion having concave and convex surfaces, thereby establishing a hand grip portion, the web of said handle portion including a smooth continuous concave surface contiguous with said upper portion of said one of said sidewalls of said main body portion;

(c) a neck portion having a passageway therethrough provided in the upper surface of said main body portion through which a first substance may be introduced into or removed from said first containing means formed by said main body portion and said integral handle portion;

(d) closure means for said passageway adapted to be selectively applied to or removed from said neck portion; and, (e) a second containing means including an annular recess provided in the surface of said main body portion, said recess having a raised annular neck portion integral therewith and raised above said surface of said main body portion, and removable closure means therefor formed to sealably adapt to said neck portion, said closure means being fixedly connected to said raised annular neck portion.

2. The bottle of claim 1, wherein said main body portion is of a generally oblong shape and uniform thickness.

3. The bottle of claim 1, wherein said handle portion is of a generally rectangular shape and uniform thickness.

4. The bottle of claim 1, wherein said first containing means is a liquid containing means and said second containing means is a solid containing means.

5. The bottle of claim 1, further comprising an eyelet integrally formed on the upper surface and at the distal end of said handle portion.

6. A bottle for containing and dispensing both liquid and solid substances comprising:

(a) a hollow main body portion having opposing sidewalls, said sidewalls having concave and convex surfaces thereby establishing a hand grip portion;

(b) a handle portion integrally formed with the upper portion of one of said sidewalls of said main body portion, said handle portion projecting laterally outwardly from said one of said sidewalls, said main body portion and said handle portion communicating and thereby forming a first substance containing means of said bottle, said handle portion having concave and convex surfaces thereby establishing a hand grip portion, the web portion of said handle portion including a smooth continuous surface contiguous with said upper portion of said one of said sidewalls of said main body portion;

(c) a threaded neck portion having a passageway therethrough provided in the upper surface of said main body portion through which a first substance may be introduced into or removed from said first containing means formed by said main body portion and said integral handle portion;

(d) closure means for said passageway adapted to be selectively threadably applied to or removed from said threaded neck portion by turning said closure means relative to said main body portion; and, (e) a second substance containing means including an annular recess provided in the surface of said main body portion, said recess having a raised annular neck portion integral therewith and raised above said surface of said main body portion, and removable closure means therefor formed to sealably adapt to said neck portion, said closure means being fixedly connected to said raised annular neck portion.

7. The bottle of claim 6, wherein said main body portion is of a generally oblong shape and uniform thickness.

8. The bottle of claim 6, wherein said handle portion is of a generally rectangular shape and of said uniform thickness of said main body portion.

9. The bottle of claim 6, further comprising an eyelet integrally formed on the upper surface and at the distal end of said handle portion.

10. A bottle for containing and dispensing both liquid and solid substances comprising:

(a) a hollow main body portion of a generally oblong shape and of a uniform thickness thereby defining opposing sidewalls, said sidewalls having concave and convex surfaces thereby establishing a hand grip portion;

(b) a hollow handle portion integrally formed with the upper portion of one of said sidewalls of said main body portion, said handle portion projecting laterally outwardly from said one of said sidewalls, said handle portion being of a generally rectangular shape and said uniform thickness of said main body portion and thereby defining upper and lower sidewalls, said main body portion and handle portion communicating and thereby forming the unitary liquid containing means of said bottle, said lower sidewall of said handle portion having concave and convex surfaces thereby establishing a hand grip portion, the web portion of said handle portion including a smooth continuous surface contiguous with said upper portion of said one of said sidewalls of said main body portion;

(c) a threaded neck portion having a passageway therethrough provided in the upper surface of said main body portion through which a liquid substance may be introduced into or removed from said liquid containing means formed by said main body portion and said integral handle portion;

(d) closure means for said passageway adapted to be selectively threadably applied to or removed from said threaded neck portion by turning said closure means relative to said main body portion; and, (e) a solid containing means including an annular recess provided in the surface of said main body portion, said recess having a raised annular neck portion integral therewith and raised above said surface of said main body portion, and a removable closure means therefor formed to sealably snap onto said neck portion, said closure means being fixedly connected to said raised annular neck portion.

11. The bottle of claim 10, further comprising an eyelet integrally formed on the upper surface and at the distal end of said handle portion.

* * * * *